United States Patent [19]

Stedman

[11] Patent Number: 4,878,980

[45] Date of Patent: Nov. 7, 1989

[54] POWER RIDGES

[76] Inventor: Lewis P. Stedman, 24391 La Hermosa, Laguna Niguel, Calif. 92677

[21] Appl. No.: 294,898

[22] Filed: Jan. 7, 1979

Related U.S. Application Data

[63] Continuation-in-part of Ser. No. 198,635, May 23, 1988, abandoned, which is a continuation-in-part of Ser. No. 68,338, Jul. 1, 1987, abandoned.

[51] Int. Cl.[4] ..... B32B 31/00

[52] U.S. Cl. ..... 156/299; 280/18; 441/65; 441/74; 428/156; 428/159; 428/163; 428/195; 428/201; 428/351; 428/354; 428/352; 428/397; 428/394

[58] Field of Search ..... 441/65, 74; 280/18; 428/156, 159, 163, 195, 201, 357, 354, 423.3, 423.5, 424.2, 424.7, 425.3, 40, 352, 522, 394, 397; 156/299

[56] References Cited

FOREIGN PATENT DOCUMENTS

| | | | |
|---|---|---|---|
| 974821 | 9/1975 | Canada | 441/65 |
| 2429145 | 2/1980 | France | 441/74 |
| 2167016 | 5/1986 | United Kingdom | 441/74 |

*Primary Examiner*—Jose G. Dees
*Assistant Examiner*—P. J. Ryan

[57] ABSTRACT

Automobile protective side-molding (renamed Power Ridges for this application) can be retrofitted onto wave riding vehicles to improve rider control and maximum speed. They do this by redirecting a portion of the fluid flow causing generation of forces which hold the vehicle down and increase its forward thrust.

1 Claim, 1 Drawing Sheet

POWER RIDGES

BACKGROUND

1. Field of Invention

This invention is a method of adding automobile protective side-molding to the bottom of wave riding vehicles (e.g. bodyboards, surfboards, surfskis, windsurfers, etc.) after manufacture (retrofitting) to enhance their performance by improving hydrodynamics.

2. Description of Prior Art

For years, channels and concaves on the bottom of wave riding vehicles have been used to improve performance. In prior art, these devices were an integral part of the design, i.e. built into the vehicle during manufacture.

OBJECTS AND ADVANTAGES

This invention allows the user to gain the advantages of channels and concaves on wave riding vehicles that did not have these features build in, or to increase the effect of built-in channels and concaves. These advantages are mainly increased speed and control.

DRAWING

Figure 1:
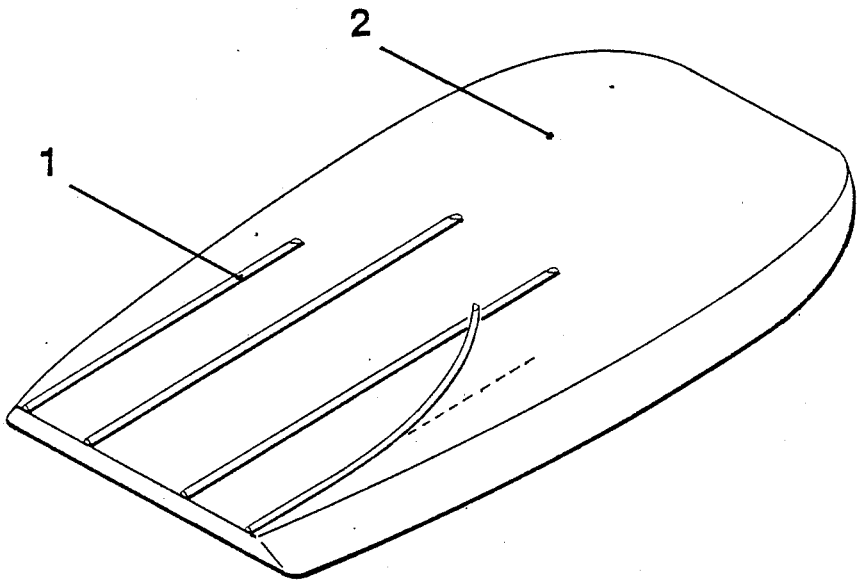
Figure 2:
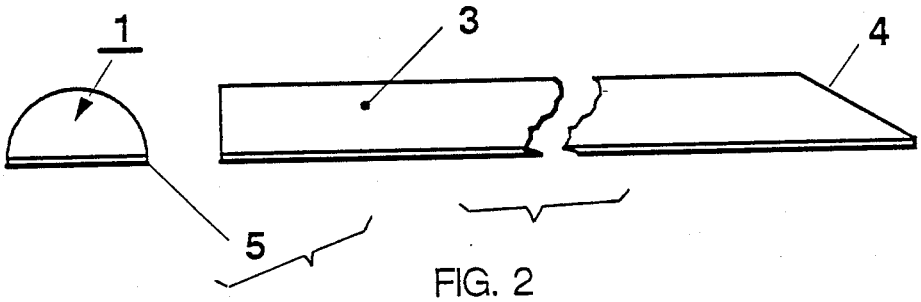

FIG. 1 shows a typical automobile protective side-molding (hereafter referred to as Power Ridges) installation on the bottom of a bodyboard. In this installation, four half-round ridges are mounted parallel to the centerline of the vehicle. Orientation, location, length, and number of ridges may be varied for different applications or to achieve different results.

The drawing shows one prototype Power Ridge. It is constructed of a soft plastic (vinyl, polyurethane, or equivalent) extrusion with a half round cross section cut off at an angle on the leading edge to reduce hydrodynamic drag. A waterproof, pressure sensitive, self-adhesive double backed tape (3M 4262 or equivalent) one side of which has been previously affixed to the Ridge's mounting interface provides the method for installation.

Various sizes and shapes of cross sections may be used to achieve different effects on performance.

REFERENCE NUMERALS FOR DRAWING

1 Power Ridge Assembly
2 Bodyboard, Bottom of
3 Extrusion, Soft Plastic
4 Angle Cut on Leading Edge
5 Adhesive Backing

FUNCTIONAL DESCRIPTION

Retrofitting Power Ridges onto any wave riding vehicle increases rider control and maximum speed of the vehicle. When moving straight down the wave, the ridges cause water in the boundary layer (right next to the bottom) to flow lengthwise along the board increasing the hydrodynamic efficiency of the vehicle. When turning or coming down the wave at an angle, two things happen:

1. Some water is deflected toward the rear of the vehicle. This causes generation of a vector force with a component which holds the vehicle into the wave and another component which pushes the vehicle forward.
2. Some water spills over the ridges generating a hydrodynamic lift which causes the vehicle to press tighter against the surface of the water.

The forces generated tend to improve the speed and performance of the vehicle.

The prototype design uses four half-round ridges mounted toward the tail of the vehicle. Size, shape of cross section, length, position, and the number of ridges can be varied to influence the relative magnitude of the forces involved.

I claim:

1. A method of improving the performance of wave riding vehicles comprising installing a number of strips of automobile, self-adhesive, flexible plastic, protective side-molding on the bottom of such vehicles so that a portion of the water flow is redirected toward the rear.

* * * * *